US011572521B1

(12) United States Patent
Poteet et al.

(10) Patent No.: US 11,572,521 B1
(45) Date of Patent: Feb. 7, 2023

(54) CORROSION RESISTANT DRY FILM LUBRICANTS

(71) Applicant: Hamilton Sundstrand Corporation, Charlotte, NC (US)

(72) Inventors: Steven Poteet, Ashland, MA (US); Blair A. Smith, South Windsor, CT (US); Marc E. Gage, Feeding Hills, MA (US); Vijay V. Pujar, Rancho Santa Fe, CA (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 17/525,444

(22) Filed: Nov. 12, 2021

(51) Int. Cl.

| | |
|---|---|
| ***C10M 125/02*** | (2006.01) |
| ***C10M 169/04*** | (2006.01) |
| *C10N 50/08* | (2006.01) |
| *C10N 30/12* | (2006.01) |

(52) U.S. Cl.
CPC ..... *C10M 125/02* (2013.01); *C10M 169/04* (2013.01); *C10M 2201/14* (2013.01); *C10N 2030/12* (2013.01); *C10N 2050/08* (2013.01)

(58) Field of Classification Search
CPC ..... C10M 125/02; C10M 169/04; C10M 2201/14; C10N 2030/12; C10N 2050/08
See application file for complete search history.

(56) References Cited

U.S. PATENT DOCUMENTS

| | | | |
|---|---|---|---|
| 3,998,270 | A | 12/1976 | Rodewald |
| 8,114,375 | B2 | 2/2012 | Jang et al. |
| 8,222,190 | B2 | 7/2012 | Zhamu et al. |
| 8,753,543 | B2 | 6/2014 | Zhamu et al. |
| 9,080,122 | B2 | 7/2015 | Kwon et al. |
| 9,493,723 | B2 * | 11/2016 | Sui ..... E21B 10/24 |
| 9,528,066 | B2 * | 12/2016 | Sui ..... C10M 125/02 |
| 9,752,035 | B2 | 9/2017 | Hasegawa et al. |
| 9,959,946 | B2 | 5/2018 | Qi et al. |
| 10,781,318 | B2 | 9/2020 | Folsom et al. |
| 10,938,292 | B2 | 3/2021 | Phillips |

(Continued)

FOREIGN PATENT DOCUMENTS

| | | | |
|---|---|---|---|
| CN | 105779081 | A | 7/2016 |
| EP | 3492533 | B1 | 11/2020 |
| WO | 2021168394 | A1 | 8/2021 |

OTHER PUBLICATIONS

L. Liu, et al., "Preparation and tribological properties of organically modified graphite oxide in liquid paraffin at ultra-low concentrations", from RSC Adv., 2015, pp. 90525-90530.

*Primary Examiner* — Ellen M McAvoy
(74) *Attorney, Agent, or Firm* — Kinney & Lange, P.A.

(57) ABSTRACT

A corrosion-resistant dry film lubricant composition includes a lubricating pigment, a binder, and a solvent. The lubricating pigment comprises graphene platelets and is dispersed in the binder, and the solvent solubilizes the lubricant pigment and the binder. The graphene platelets are oxidized and functionalized with a silane. A method of producing a corrosion-resistant lubricant includes oxidizing exfoliated graphene to produce oxidized graphene platelets, functionalizing the oxidized graphene platelets with a silane to produce functionalized graphene platelets, and dispersing the functionalized graphene platelets in a lubricant composition, wherein the lubricant composition comprises a binder and a solvent.

18 Claims, 5 Drawing Sheets

(56) References Cited

U.S. PATENT DOCUMENTS

| | | | | |
|---|---|---|---|---|
| 2010/0140792 | A1* | 6/2010 | Haddon | H01L 23/3737 257/E23.101 |
| 2010/0204072 | A1* | 8/2010 | Kwon | C10M 125/02 508/113 |
| 2013/0264121 | A1 | 10/2013 | Young et al. | |
| 2014/0038862 | A1* | 2/2014 | Haque | C10M 141/10 508/113 |
| 2014/0134092 | A1* | 5/2014 | Shankman | C01B 32/21 423/448 |
| 2014/0342955 | A1* | 11/2014 | Wu | C10M 125/02 508/122 |
| 2015/0218921 | A1* | 8/2015 | Suresh | E21B 43/20 166/305.1 |
| 2016/0160148 | A1* | 6/2016 | Rai | C10M 137/12 508/116 |
| 2017/0009171 | A1 | 1/2017 | Soto-Castillo et al. | |
| 2017/0088788 | A1* | 3/2017 | Huang | C10M 141/12 |
| 2018/0186954 | A1 | 7/2018 | Zheng et al. | |
| 2018/0190986 | A1* | 7/2018 | Zhang | C01B 32/22 |
| 2018/0274103 | A1 | 9/2018 | Poteet | |
| 2018/0371350 | A1* | 12/2018 | Pol | C10M 169/04 |
| 2019/0169443 | A1* | 6/2019 | Poteet | C09D 5/08 |
| 2019/0283340 | A1 | 9/2019 | Poteet et al. | |
| 2019/0316632 | A1 | 10/2019 | Poteet et al. | |
| 2020/0071547 | A1 | 3/2020 | Seemeyer et al. | |
| 2021/0025662 | A1 | 1/2021 | Poteet et al. | |
| 2021/0048322 | A1 | 2/2021 | Poteet et al. | |
| 2021/0102075 | A1 | 4/2021 | Poteet et al. | |
| 2021/0115568 | A1 | 4/2021 | Poteet et al. | |

* cited by examiner

CORROSION RESISTANT DRY FILM LUBRICANTS

BACKGROUND

The present disclosure relates to lubricants having improved corrosion resistance, and more particular to dry film lubricants having improved resistance to galvanic or bimetallic corrosion.

Some dry film lubricants can facilitate galvanic or bimetallic corrosion between lubricated components. In particular, dry film lubricants that include graphite can increase the rate of galvanic corrosion. Chromate-based anti-corrosion agents can be added to dry film lubricants to reduce the rate of galvanic corrosion of metals such as aluminum, copper, cadmium, zinc, magnesium, tin, silver, iron, and their alloys to reduce and slow the rate of galvanic corrosion. Chromate-based anti-corrosion agents, which contain hexavalent chromium, may pose a number of environmental and health risks, and for this reason hexavalent chromium is heavily regulated in, for example, the U.S. and the E.U.

SUMMARY

In one example, a corrosion-resistant dry film lubricant composition includes a lubricating pigment, a binder, and a solvent. The lubricating pigment comprises graphene platelets and is dispersed in the binder, and the solvent solubilizes the lubricant pigment and the binder. The graphene platelets are oxidized and functionalized with a silane.

In another example, a lubricated article includes a surface and a coating on the surface of a corrosion-resistant dry film lubricant according to another example of this disclosure.

In yet a further example, a method of producing a corrosion-resistant lubricant includes oxidizing exfoliated graphene to produce oxidized graphene platelets, functionalizing the oxidized graphene platelets with a silane to produce functionalized graphene platelets, and dispersing the functionalized graphene platelets in a lubricant composition, wherein the lubricant composition comprises a binder and a solvent.

DETAILED DESCRIPTION

The present disclosure includes functionalized graphene platelets and lubricants containing functionalized graphene platelets. The functionalized graphene platelets disclosed herein function as anti-corrosive agents and allow for the preparation of lubricants that do not include chromate-based anti-corrosive agents. Further, the functionalized graphene platelets disclosed herein function as lubricating pigments and have improved dispersion as compared to unfunctionalized graphene.

Figure 1:
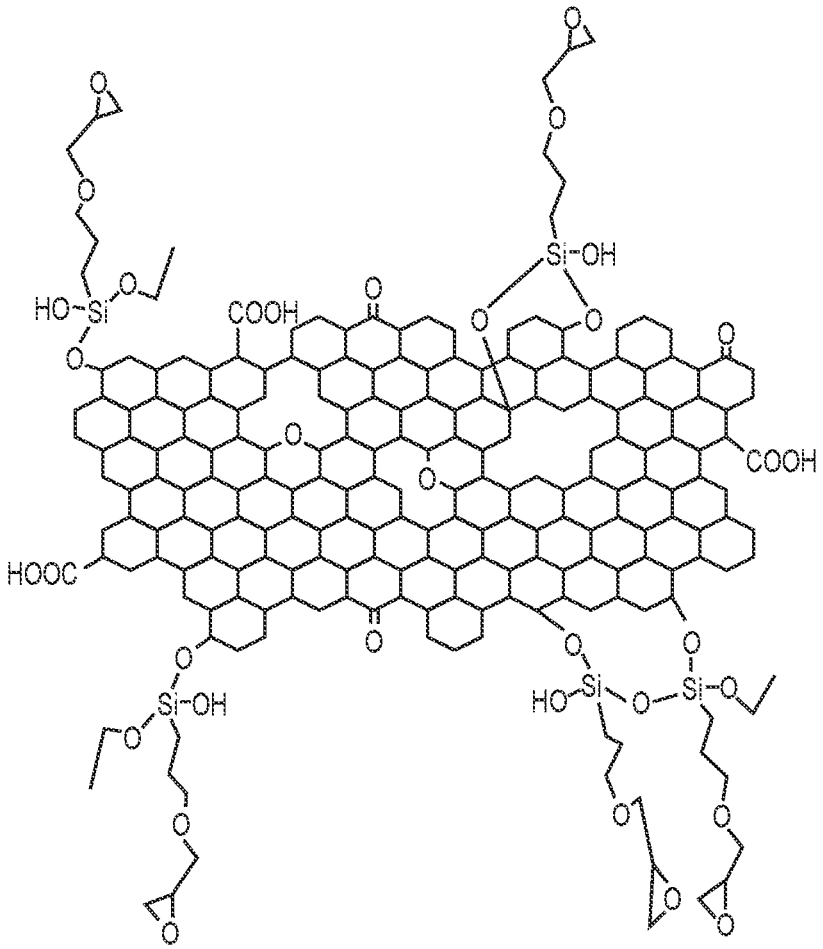
FIG. 1 is a structural formula of an example of a graphene platelet functionalized with a silane.

FIG. 1 is a structural formula of an example of a graphene platelet functionalized with a silane. Graphene is a single layer of carbon atoms arranged in a two dimensional and generally hexagonal lattice. Graphite is composed of many layers of graphene. Graphene can be advantageously used as a lubricant pigment due to the ability of individual graphene layers to slide relative to one another. Graphite, similarly, can be used as a lubricant pigment due to the ability of graphene layers of the graphite to shear under friction force and slide relative to one another.

The graphene platelet depicted in FIG. 1 is an oxidized graphene platelet (e.g., a graphene oxide or a reduced graphene oxide), including oxygen-containing functional groups, such as hydroxyl groups, and is functionalized with silane groups via a condensation reaction. As used herein, "surface oxygen" and "surface oxides" refer to the oxygen-containing functional groups that extend away from a planar surface of an oxidized graphene platelet and are suitable for functionalization with silanes. As is shown in FIG. 1, the silane forms silyl ether linkages with the graphene platelet. Each silane can form single or multiple silyl ether linkages with the graphene platelet. The silane can be, for example, an alkoxysilane, such as a monoalkoxy-, dialkoxy-, or trialkoxysilane. The alkoxy group can be selected based on steric properties and ability of the alkoxysilane to form linkages with the graphene platelet. For example, the alkoxysilane can be a methoxysilane or an ethoxysilane. As will be explained in more detail, especially with respect to FIGS. 2-3, the silane also includes a functional group that is selected based on its interaction with other lubricant components and/or the surface of a lubricated article.

In the depicted example, the graphene platelet is functionalized with (3-glycidyloxypropyl)triethoxysilane. However, the graphene platelet can be functionalized with other suitable silanes, such as (3-glycidyloxypropyl)trimethoxysilane or (3-aminopropyl)trimethoxysilane. The oxidized graphene can be, for example, graphene oxide (GO), reduced graphene oxide (rGO), or hydroxy graphene. As used herein, "graphene", "graphene oxide", "reduced graphene oxide," and "hydroxy graphene" refer to graphene platelets. The diameter of the graphene platelet can be selected to optimize lubricity. As used herein, the "diameter" of a graphene platelet refers to an average diameter of the two-dimensional lattice of the graphene platelet. For example, the graphene platelet can have an average diameter of between 1 μm and 250 μm. The "thickness" of a graphene platelet refers to the average width of the graphene platelets in a direction normal to the lattice of the graphene platelet.

The graphene platelet depicted in FIG. 1 is depicted as a single layer of carbon for illustrative purposes. The graphene platelet can also be, for example, a graphene nanoplatelet (GNP) having multiple graphene layers. GNPs including multiple layers can be similarly oxidized and functionalized to produce functionalized GNPs having advantageous lubrication and anti-corrosion properties. For example, the functionalized GNPs can have an average thickness of between one and twenty graphene layers, with the exterior layers including functionalized silanes.

Graphite platelets have desirable properties for increasing the lubricity of lubricants, but are conductive and can act as conduits to facilitate galvanic corrosion. For this reason, graphite-containing lubricants usually contain an additional corrosion inhibitor, such as a chromate-based inhibitor or is similarly restricted on certain metals, such as aluminum, as the graphite may induce galvanic corrosion. Graphene platelets also have desirable properties for increasing the lubricity of lubricants and provide improved resistance to galvanic corrosion as compared to graphite platelets. Advantageously, graphenes inhibit, rather than facilitate, galvanic corrosion. Functionalized graphene platelets provide improved dispersion into a lubricant matrix and have reduced agglomeration as compared to unfunctionalized graphenes. As such, functionalized graphenes advantageously function both to prevent corrosion and to increase lubricity, eliminating or reducing the need for chromate-based substances. The functionalized graphenes can be used as lubricant pigments and allow for the creation of corrosion-resistant lubricants that do not include chromate-based inhibitors.

Figure 2:
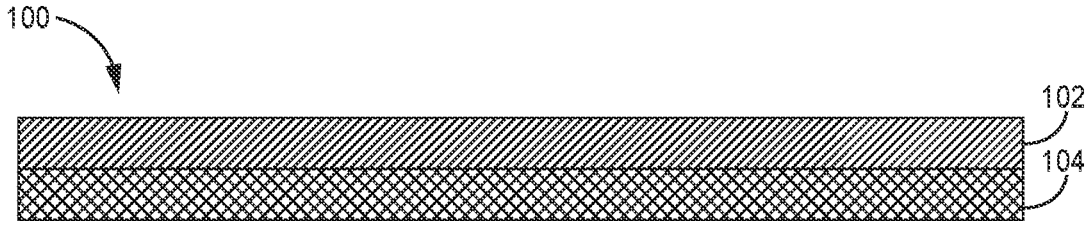
FIG. 2 is a schematic drawing of an example of a surface coated with a corrosion-resistant dry film lubricant including a functionalized graphene platelet.

FIG. 2 is a schematic drawing of lubricated article 100, which is an example of a surface coated with a corrosion-resistant dry film lubricant including a functionalized graphene platelet. Lubricated article includes dry film lubricant 102 and article 104.

Dry film lubricant 102 is a corrosion-resistant dry film lubricant and coats a surface of article 104. Dry film lubricant 102 includes a lubricant pigment, a binder, and a solvent. The lubricating pigment includes silane-functionalized graphene platelets to provide lubricity to dry film lubricant 102. The binder is a polymer, such as an epoxy, and functions to facilitate the dispersion of the lubricating pigment, promote homogeneity of the lubricant composition, and to bind the pigment to the surface of the article. The solvent functions to solubilize the binder and the lubricating pigment, and further to act as a carrier to dispense dry film lubricant 102. In some examples, the solvent can evaporate after the lubricant is applied. The volatility of the solvent can be selected to optimize drying of dry film lubricant 102.

Article 104 is an article requiring lubrication, such as a fastener, a valve component, a slide, or another part that functions by sliding relative to a separate structure. Article 104 is formed of a metal material that is susceptible to galvanic corrosion. For example, article 104 can be formed from an aluminum material. In operational conditions, article 104 is disposed adjacent to a second metallic component and dry film lubricant 102 provides lubricity between article 104 and the second metallic component, allowing article 104 and the second metallic component to slide relative to one another.

Existing graphite-based lubricants can facilitate galvanic corrosion between, for example, article 104 and the second metallic component or article 104 and a component of dry film lubricant 102, requiring an additional corrosion inhibitor to prevent galvanic corrosion. As described previously, chromate-based corrosion inhibitors are often added to existing graphite-based lubricants to prevent galvanic corrosion. Chromate-based compounds may pose a number of environmental and health risks, and are heavily regulated in, for example, the U.S. and the E.U. Advantageously, the silane-functionalized GNPs in dry film lubricant 102 both increase lubricity and prevent corrosion without the need for an additional corrosion inhibitor. As such, in some examples, dry film lubricant 102 does not include a chromate compound and is, therefore, substantially chromate-free.

Although the anti-corrosion properties of silane-functionalized graphene platelets have previously been characterized in paint and coating primers, the ability of silane-functionalized graphene platelets to function both as anti-corrosives and as lubricant pigments was unknown. In particular, at high concentrations, silane-functionalized graphene platelets can cause the viscosity of a lubricant composition to increase substantially, which is undesirable for lubricant function. However, adding functionalized graphene platelets at a relatively low concentration in the lubricant composition confers substantial anti-corrosion and lubricity properties to the lubricant composition without substantially increasing the viscosity of the lubricant composition. For example, adding functionalized graphene at a concentration between 0.1 wt % and 0.5 wt % in the lubricant composition provides both sufficient lubricity and anti-corrosion properties while maintaining acceptable viscosity. In some examples, the resultant lubricant composition has acceptable viscosity with up to 5 wt % of functionalized graphene platelets. Advantageously, lubricant compositions that include functionalized graphene at a concentration of 0.1 wt %— 5 wt % do not require additional lubricant pigments to achieve sufficient lubricity and similarly do not require additional anti-corrosives, such as chromate compounds or other anti-corrosion compounds, to prevent galvanic corrosion.

As will be described in more detail with respect to FIG. 3, the silane used to functionalize the oxidized graphene can further be selected to improve dispersibility. For example, the silane can be selected to increase interactions between the functionalized graphene lubricant pigment of dry film lubricant 102 and the surface of article 104, and further to decrease interactions between the functionalized lubricant graphene pigment and other components of the dry film lubricant 102, including adjacent functionalized graphene pigments, allowing for improved lubricity over conventional graphite lubricant pigments. Notably, unfunctionalized graphenes can exhibit poor dispersion in lubricant compositions. The functionalized graphenes disclosed herein have substantially improved dispersion as compared to unfunctionalized graphenes, improving the lubricity of lubricant compositions containing the functionalized graphenes disclosed herein as compared to lubricant compositions containing only unfunctionalized graphenes. To this extent, lubricant compositions including a functionalized graphene described herein offer a number of advantages relating to lubricity and galvanic corrosion over conventional lubricant compositions.

Although additional components that confer lubricity or anti-corrosive properties are not required for the function of dry film lubricant 102, dry film lubricant 102 can include additional lubricating and/or anti-corrosive agents in some examples. For example, dry film lubricant 102 can also include $MoS_2$, $WS_2$, and/or BN to improve lubricity. Similarly, in some examples dry film lubricant 102 can include chromate-based corrosion inhibitors or another suitable corrosion inhibitor, such as magnesium silicate, praseodymium hydroxide, a zinc salt, a rare earth trivalent chromium ($RECRO_3$) compound, or another suitable compound. $RECRO_3$ compounds include trivalent chromium and at least one rare earth cation. Example rare earth cations include cerium (Ce), dysprosium (Dy), erbium (Er), europium (Eu), gadolinium (Gd), holmium (Ho), lanthanum (La), lutetium (Lu), neodymium (Nd), praseodymium (Pr), promethium (Pm), samarium (Sm), scandium (Sc), terbium (Tb), thulium (Tm), ytterbium (Yb) and yttrium (Y) and the alkaline earth element precursor includes at least one of magnesium (Mg), calcium (Ca), strontium (Sr), and barium (Ba). $RECRO_3$ compounds are substantially less toxic than hexavalent chromium-based corrosion inhibitors.

Figure 3:
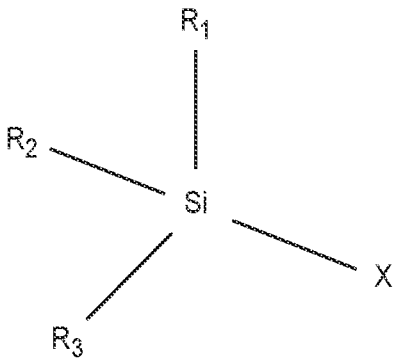
FIG. 3 is a structural formula of an example of a silane suitable for functionalizing a graphene platelet.

FIG. 3 is a structural formula of an example of a silane suitable for functionalizing a graphene platelet. FIG. 3 includes a silicon atom covalently bonded to three R groups ($R_1$-$R_3$) and one X group. R groups represent positions that can be occupied by leaving groups. X represents a position that is not occupied by a leaving group and instead is occupied by a functional group for affecting the lubricity of a functionalized graphene platelet. As used herein, "leaving groups" refer to functional groups that retain an electron pair following heterolytic bond cleavage between the silicon atom and the leaving group. The leaving group can be, for example, a weak Lewis base. In some examples, the leaving groups at $R_1$-$R_3$ are ethers, such as ethoxy- or methoxy-moieties, or alcohols. At least one of $R_1$-$R_3$ is a leaving group to facilitate the formation of a covalent bond between the silane and an oxidized graphene platelet. However, the others of $R_1$-$R_3$ can be non-leaving groups. For example, one or more of $R_1$-$R_3$ can be an alkane, such as methyl- or ethyl-moieties, or a hydrogen. $R_1$-$R_3$ can be the same or different from one another.

X can include one or more an alkane, a haloalkane, a perhaloalkane, an ester, an ether, an amide, an amine, and an epoxy. For example, X can include an alkane chain, an ether, and an epoxy group. The chemical composition and structure of X is selected to improve lubricity of the functionalized graphene. For example, the structure of X can be selected to improve interlaminar spacing between adjacent functionalized graphene platelets in dry lubricant film 102 and improve the ability of adjacent functionalized graphene platelets to slide relative to each another. As a specific example, including a perfluoro group in X can increase interlaminar spacing, improving lubricity, as well as impart greater hydrophobic properties to the lubricant. Advantageously, improving the ability of adjacent functionalized graphene platelets to slide relative to one another improves the lubricity of dry film lubricant 102.

Similarly, the chemical composition and structure of X can be selected to improve dispersion in dry lubricant film 102. For example, X can be selected based on the chemistry of a binder for a dry film lubricant, such that there is an unfavorable interaction between the binder and the functionalized graphene that increases the propensity of the functionalized graphene to localize adjacent to the surface of article 104. As a specific example, X can include a perfluoro group to cause the functionalized graphene to repel from other hydrocarbons in dry film lubricant 102. As a further example, the chemical composition and structure of X can be selected to improve adhesion between the functionalized graphene platelets and article 104, thereby increasing the propensity of the functionalized graphene platelets to localize adjacent to the surface of article 104. Advantageously, choosing a chemical composition and structure of X that increases the propensity of the functionalized graphene to localizes adjacent to the surface of article 104 improves the lubricity of dry film lubricant 102.

The identities of $R_1$-$R_3$ and X can further be selected based on their impact on the efficiency or rate of functionalization of an oxidized graphene platelet. For example, one or more of $R_1$-$R_3$ and X can be selected based on their steric properties, as sufficiently bulky groups can inhibit functionalization of oxidized graphene platelets.

Figure 4:
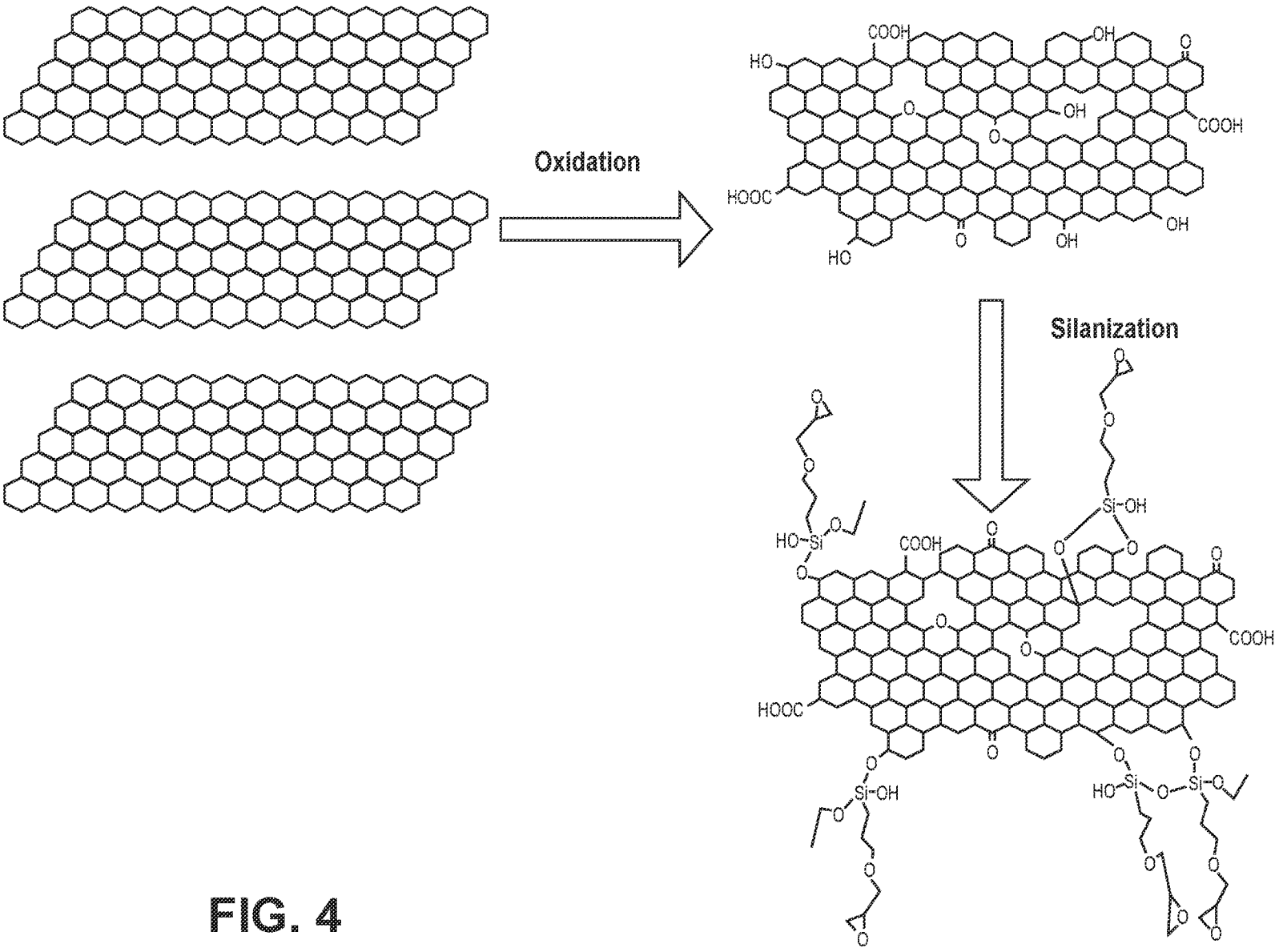
FIG. 4 is a reaction schematic for making an example of a graphene platelet functionalized with a silane.

FIG. 4 is a reaction schematic for making an example of a graphene platelet functionalized with a silane. According to the reaction schematic shown in FIG. 4, graphite is exfoliated and oxidized to form oxidized graphene. The graphite can be exfoliated using, for example, high-shear mixing, ball milling, sonication, chemical exfoliation, use of exfoliating surfactants, or a combination of the foregoing techniques, among other options. High-shear mixing can also be used to enhance dispersion of the graphene platelets in solution. In some examples, exfoliation and oxidation occurs substantially simultaneously. For example, exfoliation can be performed in oxidizing conditions, such as via a chemical exfoliation technique, to produce exfoliated and oxidized graphene. Chemical reduction of the graphene can be performed to reduce the number of surface oxides produced by oxidation.

Following exfoliation and oxidation, the oxidized graphene is silanized to yield functionalized graphene. The oxidized graphene is silanized by a condensation reaction between a silane and a surface oxygen of the oxidized graphene, yielding a functionalized graphene and a free leaving group. The silane is one having the chemical formula described previously with respect to FIG. 3. As at least one of $R_1$-$R_3$ of the structural formula shown in FIG. 3 is a leaving group, at least one of $R_1$-$R_3$ is covalently bonded to a graphene platelet.

The silanization reaction can be conducted by first dispersing graphene platelets in a reaction solvent. The concentration of graphene platelets in the solvent can be 10-30 wt % of the reaction. The reaction solvent can be, for example, a polar solvent. In some examples, the polar solvent can be an alcohol, such as ethanol. In some examples, the silanes functionalize up to 15 wt % of surface oxygen of the oxidized graphene platelets.

Although the disclosures herein refer generally to functionalizing graphene platelets with silanes, other suitable compounds can be used to functionalize graphenes to reduce corrosion and/or improve lubricity. In these examples, the reaction schematic shown in FIG. 4 can be modified to include an alternative reaction step to functionalize the oxidized graphene in place of the depicted silanization reaction.

Figure 5:
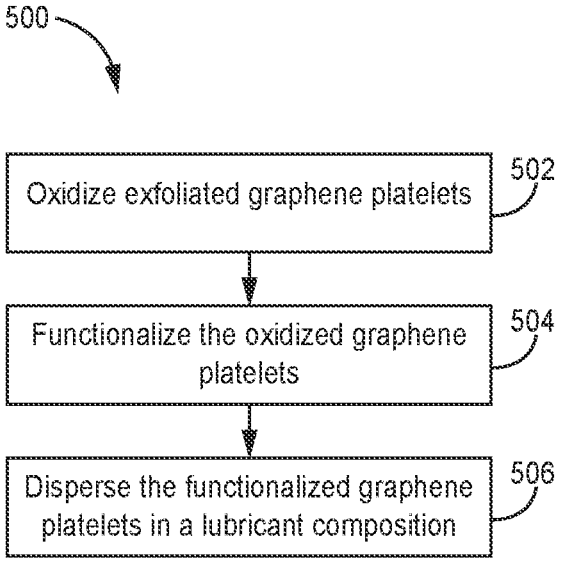
FIG. 5 is flow diagram of an example of a method of producing a corrosion-resistant dry film lubricant including a functionalized graphene platelet.

FIG. 5 is flow diagram of method 500, which is an example of a method of producing a corrosion-resistant dry film lubricant including a functionalized graphene platelet. Method 500 includes steps of oxidizing exfoliated graphene platelets (step 502), functionalizing the oxidized graphene platelets (step 504), and dispersing the functionalized graphene platelets in a lubricant composition (step 506).

Oxidizing the exfoliated graphene platelets (step 502) and functionalizing the oxidized graphene platelets (step 504) can be performed in substantially the same manner as described previously with respect to the reaction schematic of FIG. 4. In step 506, the functionalized graphene platelets are dispersed in a lubricant composition, such as dry film lubricant 102. The functionalized graphene platelets are added to a binder and solvent to create a lubricant composition. The functionalized graphene platelets are dispersed in the lubricant composition by sonication, high-shear mixing, or another suitable method to create a homogeneous mixture. The resultant lubricant composition is a corrosion-resistant lubricant composition.

As described previously, at high concentrations, the functionalized graphene platelets can cause the viscosity of the lubricant composition to increase substantially, which is undesirable for lubricant function. However, adding functionalized graphene platelets at a relatively low concentration in the lubricant composition, such as 0.1 wt % and 0.5 wt %, confers substantial anti-corrosion and lubricity properties to the lubricant composition without substantially increasing the viscosity of the lubricant composition. In some examples, the resultant lubricant composition has acceptable viscosity with up to 5 wt % of functionalized graphene platelets.

Advantageously, lubricant compositions that include a functionalized graphene platelet described herein at a concentration of 0.1 wt %-5 wt % do not require additional lubricant pigments to achieve sufficient lubricity and similarly do not require additional anti-corrosives to prevent galvanic corrosion. To this extent, lubricant compositions that include a functionalized graphene described herein do not require, for example, a chromate-based corrosion inhibitor and are, therefore, substantially chromate-free. Further, the functionalized graphene platelets described herein offer improved lubricity over conventional graphite and graphene lubricant pigments.

DISCUSSION OF POSSIBLE EMBODIMENTS

The following are non-exclusive descriptions of possible embodiments of the present invention.

An embodiment a corrosion-resistant dry film lubricant composition includes a lubricating pigment, a binder, and a solvent. The lubricating pigment comprises graphene platelets and is dispersed in the binder, and the solvent solubilizes the lubricant pigment and the binder. The graphene platelets are oxidized and functionalized with a silane.

The corrosion-resistant dry film lubricant composition of the preceding paragraph can optionally include, additionally and/or alternatively, any one or more of the following features, configurations and/or additional components:

A corrosion-resistant dry film lubricant composition according to an exemplary embodiment of this disclosure includes, among other possible things, a lubricating pigment, a binder, and a solvent. The lubricating pigment comprises graphene platelets and is dispersed in the binder, and the solvent solubilizes the lubricant pigment and the binder. The graphene platelets are oxidized and functionalized with a silane.

A further embodiment of the foregoing corrosion-resistant dry film lubricant, wherein the graphene platelets have a concentration of 0.1 wt % to 0.5 wt % in the lubricant composition.

A further embodiment of any of the foregoing corrosion-resistant dry film lubricants, wherein the silane forms at least one silyl ether linkage with the graphene platelets.

A further embodiment of any of the foregoing corrosion-resistant dry film lubricants, wherein the silane comprises an alkoxysilane.

A further embodiment of any of the foregoing corrosion-resistant dry film lubricants, wherein the silane is selected from a group consisting of a monoalkoxysilane, a dialkoxysilane, and a trialkoxysilane.

A further embodiment of any of the foregoing corrosion-resistant dry film lubricants, wherein the silane is selected to increase the propensity of the graphene platelets to localize adjacent to a surface of an article.

A further embodiment of any of the foregoing corrosion-resistant dry film lubricants, wherein the dry film lubricant composition does not include chromate.

A further embodiment of any of the foregoing corrosion-resistant dry film lubricants, wherein the graphene platelets are graphene nanoplatelets.

A further embodiment of any of the foregoing corrosion-resistant dry film lubricants, wherein the graphene nanoplatelets have average diameters between 1 micrometer and 25 micrometers.

A further embodiment of any of the foregoing corrosion-resistant dry film lubricants, wherein the silanes functionalize up to 15 wt % of oxygen of the graphene platelets.

A further embodiment of any of the foregoing corrosion-resistant dry film lubricants, wherein the graphene platelets have a concentration of less than 5 wt % in the lubricant composition.

A further embodiment of any of the foregoing corrosion-resistant dry film lubricants, wherein the silane is selected to improve lubricity.

A further embodiment of any of the foregoing corrosion-resistant dry film lubricants, wherein the dry film lubricant composition does not include chromate.

The graphene platelets have average diameters between 1 micrometer and 25 micrometers.

A further embodiment of any of the foregoing corrosion-resistant dry film lubricants, wherein the silane is represented by the following formula:

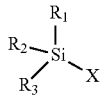

A further embodiment of any of the foregoing corrosion-resistant dry film lubricants, wherein $R_1$ is selected from a group consisting of ethers and alcohols.

A further embodiment of any of the foregoing corrosion-resistant dry film lubricants, wherein $R_2$ is selected from a group consisting of alcohols, ethers, alkanes, and hydrogen.

A further embodiment of any of the foregoing corrosion-resistant dry film lubricants, wherein $R_3$ is selected from a group consisting of alcohols, ethers, alkanes, and hydrogen.

A further embodiment of any of the foregoing corrosion-resistant dry film lubricants, wherein X includes one or more of an alkane, a haloalkane, a perhaloalkane, an ester, an ether, an amide, an amine, and an epoxy.

A further embodiment of any of the foregoing corrosion-resistant dry film lubricants, wherein at least one of $R_1$, $R_2$, and $R_3$ is covalently bonded to the graphene platelets.

An embodiment of a lubricated article includes a surface and a corrosion-resistant dry film lubricant. The coating of the corrosion-resistant dry lubricant is on the surface.

The lubricated article of the preceding paragraph can optionally include, additionally and/or alternatively, any one or more of the following features, configurations and/or additional components:

A lubricated article according to an exemplary embodiment of this disclosure includes, among other possible things, a surface and a corrosion-resistant dry film lubricant according to another embodiment of this disclosure. The coating of the corrosion-resistant dry lubricant is on the surface.

A further embodiment of the foregoing lubricated article, wherein the surface comprises an aluminum material.

An embodiment of a method of producing a corrosion-resistant lubricant includes oxidizing exfoliated graphene to produce oxidized graphene platelets, functionalizing the oxidized graphene platelets with an silane to produce functionalized graphene platelets, and dispersing the functionalized graphene platelets in a lubricant composition, wherein the lubricant composition comprises a binder and a solvent.

The method of the preceding paragraph can optionally include, additionally and/or alternatively, any one or more of the following features, configurations and/or additional components:

A method of producing a corrosion-resistant lubricant includes according to an exemplary embodiment of this disclosure includes, among other possible things, oxidizing exfoliated graphene to produce oxidized graphene platelets, functionalizing the oxidized graphene platelets with a silane to produce functionalized graphene platelets, and dispersing the functionalized graphene platelets in a lubricant composition, wherein the lubricant composition comprises a binder and a solvent.

A further embodiment of the foregoing method, wherein functionalizing the oxidized graphene platelets with a silane comprises functionalizing up to 15 wt % of oxygen of the oxidized graphene platelets.

A further embodiment of any of the foregoing methods, wherein dispersing the functionalized platelets in the lubricant composition comprises adding the functionalized graphene platelets at a concentration of 0.1 wt % to 0.5 wt % in the lubricant composition.

A further embodiment of any of the foregoing methods, wherein the silane forms at least one silyl ether linkage with the oxidized graphene platelets.

A further embodiment of any of the foregoing methods, wherein the silane is selected from a group consisting of a monoalkoxysilane, a dialkoxysilane, and a trialkoxysilane.

A further embodiment of any of the foregoing methods, wherein the silane is represented by the following formula:

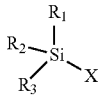

A further embodiment of any of the foregoing methods, wherein $R_1$ is selected from a group consisting of ethers and alcohols.

A further embodiment of any of the foregoing methods, wherein $R_2$ is selected from a group consisting of alcohols, ethers, alkanes, and hydrogen.

A further embodiment of any of the foregoing methods, wherein $R_3$ is selected from a group consisting of alcohols, ethers, alkanes, and hydrogen.

A further embodiment of any of the foregoing methods, wherein X includes one or more of an alkane, a haloalkane, a perhaloalkane, an ester, an ether, an amide, an amine, and an epoxy.

A further embodiment of any of the foregoing methods, wherein at least one of $R_1$, $R_2$, and $R_3$ is covalently bonded to the graphene platelets.

A further embodiment of any of the foregoing methods, wherein the silane is selected to increase the propensity of the functionalized graphene platelets to localize adjacent to a surface of an article.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A corrosion-resistant dry film lubricant composition comprising:

a lubricating pigment comprising graphene platelets, wherein the graphene platelets are oxidized and functionalized with a silane;

a binder, wherein the lubricating pigment is dispersed in the binder; and a solvent for solubilizing the lubricant pigment and the binder;

wherein the silanes functionalize up to 15 wt % of oxygen of the graphene platelets.

2. The corrosion-resistant dry film lubricant composition of claim 1, wherein the graphene platelets have a concentration of 0.1 wt % to 5 wt % in the lubricant composition.

3. The corrosion-resistant dry film lubricant composition of claim 1, wherein the silane forms at least one silyl ether linkage with the graphene platelets.

4. The corrosion-resistant dry film lubricant composition of claim 1, wherein the silane comprises an alkoxysilane.

5. The corrosion-resistant dry film lubricant composition of claim 1, wherein the silane is selected from a group consisting of a monoalkoxysilane, a dialkoxysilane, and a trialkoxysilane.

6. The corrosion-resistant dry film lubricant composition of claim 1, wherein the silane is represented by the following formula:

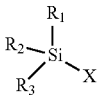

wherein:

$R_1$ is selected from a group consisting of ethers and alcohols;

$R_2$ is selected from a group consisting of alcohols, ethers, alkanes, and hydrogen;

$R_3$ is selected from a group consisting of alcohols, ethers, alkanes, and hydrogen;

X includes one or more of an alkane, a haloalkane, a perhaloalkane, an ester, an ether, an amide, an amine, and an epoxy; and at least one of $R_1$, $R_2$, and $R_3$ is covalently bonded to the graphene platelets.

7. The corrosion-resistant dry film lubricant composition of claim 1, wherein the silane is selected to increase the propensity of the graphene platelets to localize adjacent to a surface of an article.

8. The corrosion-resistant dry film lubricant composition of claim 1, wherein the dry film lubricant composition does not include chromate.

9. The corrosion resistant dry film lubricant composition of claim 1, further comprising an additional corrosion inhibitor.

10. The corrosion-resistant dry film lubricant composition of claim 1, wherein the graphene platelets have average diameters between 1 micrometer and 25 micrometers.

11. The corrosion-resistant dry film lubricant composition of claim 1, wherein:

the silanes functionalize up to 15 wt % of oxygen of the graphene platelets;

the graphene platelets have a concentration of less than 5 wt % in the lubricant composition;

the silane is selected to improve lubricity;

the dry film lubricant composition does not include chromate;

the graphene platelets have average diameters between 1 micrometer and 25 micrometers; and the silane is represented by the following formula:

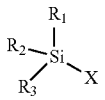

wherein:

$R_1$ is selected from a group consisting of ethers and alcohols;

$R_2$ is selected from a group consisting of alcohols, ethers, alkanes, and hydrogen;

$R_3$ is selected from a group consisting of alcohols, ethers, alkanes, and hydrogen;

X includes one or more of an alkane, a haloalkane, a perhaloalkane, an ester, an ether, an amide, an amine, and an epoxy; and at least one of $R_1$, $R_2$, and $R_3$ is covalently bonded to the graphene platelets.

12. A lubricated article comprising:

a surface;

a coating of the corrosion-resistant dry film lubricant composition of claim 1 on the surface.

13. A method of producing a corrosion-resistant lubricant, the method comprising:

oxidizing exfoliated graphene to produce oxidized graphene platelets;

functionalizing the oxidized graphene platelets with a silane to produce functionalized graphene platelets; and dispersing the functionalized graphene platelets in a lubricant composition, wherein the lubricant composition comprises a binder and a solvent;

wherein functionalizing the oxidized graphene platelets with a silane comprises functionalizing up to 15 wt % of oxygen of the oxidized graphene platelets.

14. The method of claim 13, wherein dispersing the functionalized platelets in the lubricant composition comprises adding the functionalized graphene platelets at a concentration of 0.1 wt % to 0.5 wt % in the lubricant composition.

15. The method of claim 13, wherein the silane forms at least one silyl ether linkage with the oxidized graphene platelets.

16. The method of claim 13, where in the silane is selected from a group consisting of a monoalkoxysilane, a dialkoxysilane, and a trialkoxysilane.

17. The method of claim 13, wherein the silane is represented by the following formula:

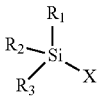

wherein:

$R_1$ is selected from a group consisting of ethers and alcohols;

$R_2$ is selected from a group consisting of alcohols, ethers, alkanes, and hydrogen;

$R_3$ is selected from a group consisting of alcohols, ethers, alkanes, and hydrogen;

X includes one or more of an alkane, a haloalkane, a perhaloalkane, an ester, an ether, an amide, an amine, and an epoxy; and at least one of $R_1$, $R_2$, and $R_3$ is covalently bonded to the graphene platelets.

18. The method of claim 13, wherein the silane is selected to increase the propensity of the functionalized graphene platelets to localize adjacent to a surface of an article.

* * * * *